United States Patent [19]

Franks, Jr.

[11] Patent Number: 4,752,047

[45] Date of Patent: Jun. 21, 1988

[54] CABLE SPOOL HOLDER

[76] Inventor: George J. Franks, Jr., 664 Thompson Cir., Inverness, Ill. 60072

[21] Appl. No.: 37,041

[22] Filed: Apr. 10, 1987

[51] Int. Cl.[4] ..... B65H 57/18; F16M 11/32; B66C 23/28

[52] U.S. Cl. ..... 242/129.6; 242/139; 248/166; 211/204; 292/304

[58] Field of Search ..... 248/166; 211/198, 203, 211/195, 204; 242/55.2, 129.6, 129.62, 134, 85, 106, 129.5, 130, 139, 134, 141, 129.51; 292/121, 128, 304, DIG. 49

[56] References Cited

U.S. PATENT DOCUMENTS

| | | | |
|---|---|---|---|
| 877,272 | 1/1908 | Warlick | 292/304 |
| 1,390,773 | 9/1921 | Foster | 292/304 |
| 1,556,624 | 10/1925 | Pavenick | 211/204 X |
| 1,615,149 | 1/1927 | Trebes | 242/129.6 |
| 2,019,090 | 10/1935 | Pepper | 248/166 |
| 2,662,702 | 12/1953 | Bruestle | 242/129.6 X |
| 2,957,644 | 10/1960 | Beardslee | 242/139 |
| 4,172,608 | 10/1979 | Brown, Jr. | 242/85 |
| 4,391,422 | 7/1983 | McDonald | 242/129.6 |

*Primary Examiner*—David Werner
*Attorney, Agent, or Firm*—Wall and Roehrig

[57] ABSTRACT

A collapsible cable or wire spool stand which, when erected, provides a stable platform about which a spool of cable or wire material can be supported to permit the withdrawal of cable or wire contained on the spool. The support structure may be readily collapsed from its erected configuration to minimize storage space. In a collapsed configuration, the horizontally disposed axle, upon which the spool is supported functions as a convenient handle to form a convenient handle for carrying the spool support stand.

6 Claims, 1 Drawing Sheet

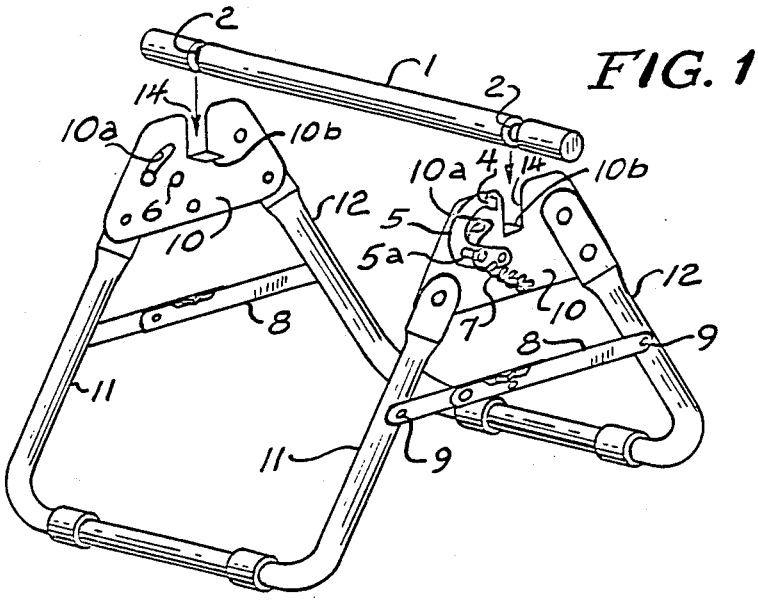
FIG. 1
FIG. 3
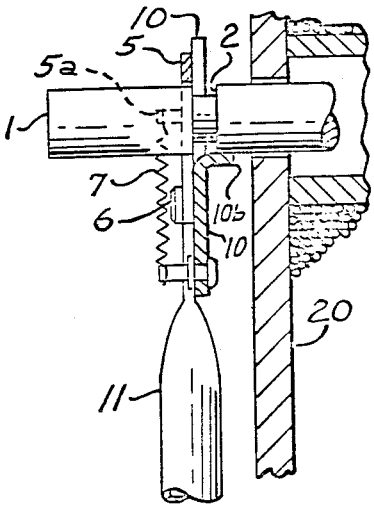
FIG. 2
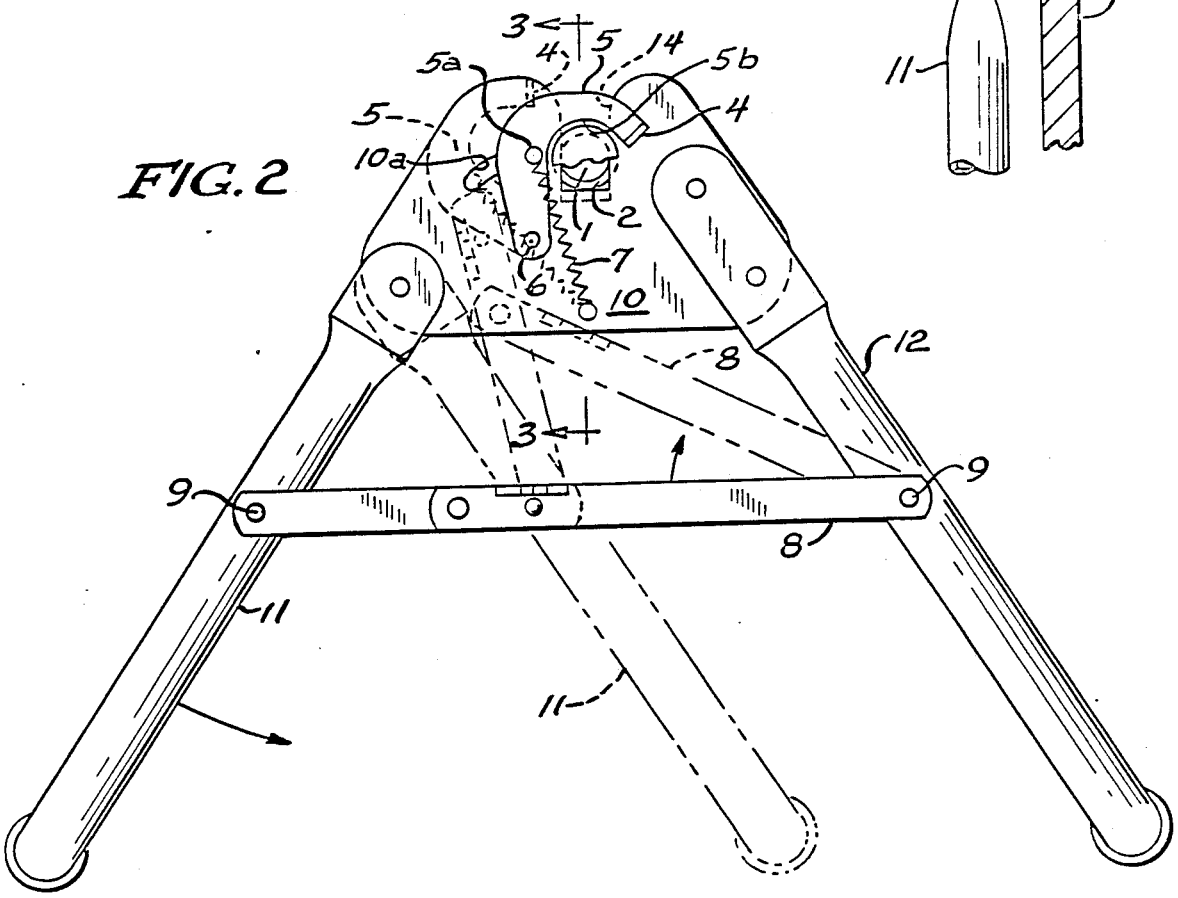

CABLE SPOOL HOLDER

BACKGROUND OF THE INVENTION

This invention relates in general to apparatus for supporting a spool to dispense cable or wire and, in particular, to a cable or wire spool holder that forms a stable stand when in an erected configuration, but is collapsible into a compact form to minimize storage space when not in use. More particularly, but without restriction to the particular embodiment and/or use which is shown and described for purposes of illustration, this invention relates to a portable cable or wire spool holder having folding legs, and a locking brace, such that the holder may be erected into a stable configuration for removing wire or cable from a spool, and thereafter collapsed into a compact folded form minimizing storage space requirements, with the spool support functioning as a carry handle. The spool is carried on a spool support rod which is retained in the spool holder by a latch structure. The latch structure permits the spool holder to be carried with a spool on the spool holder, without having the spool-bearing support rod pulling free from the spool holder under the weight of the spool carried thereupon.

To facilitate removing wire or cable from a spool, it is known to support the spool upon a horizontally disposed support rod or axle, which permits the spool to rotate upon the support member to facilitate drawing the wire or cable material from the spool. In this manner, the spool may be positioned at a fixed location while being free to rotate about a horizontal axis to permit the wire or cable material to be withdrawn therefrom.

The present invention provides a support stand or holder for a spool of wire or cable material. In an erected configuration the support stand provides a stable platform from which wire or cable can be withdrawn from a spool, as the spool is permitted to freely rotate about a horizontal axis supported on a rod or axle member. A pair of bearing surfaces, formed from a portion of the cable support stand structure, provide an increased bearing surface to distribute the weight of the spooled material on the support stand. Releasable latches are carried on the support stand and are positionable to permit convenient and easy engagement and removal of the spool from the axle or spool support member. When the spool support stand is not in use, the stand may be readily collapsed to minimize storage space, with the horizontal axle member, upon which the spool is supported when in use, forming a handle for carrying the apparatus.

SUMMARY OF THE INVENTION

It is, therefore, an object of this invention to improve spool stands or holders for supporting cable or wire spools when withdrawing these materials from the spool.

Another object of this invention is to improve wire or cable spool holders by forming the support structure such that the stand may be collapsed when not in use to minimize storage space requirements.

A further object of this invention is to increase the bearing support surface for a spool supporting axle, about which the cable or wire spool is supported for rotation, while dispensing the cable or wire material therefrom.

Still another object of this invention is to permit the cable spool supporting axle of the spool holder to be readily removed from and engaged with the cable spool support structure.

Yet another object of this invention is to facilitate carrying the cable spool holder structure when the stand is in either a collapsed configuration or is supporting a spool of material.

These and other objects are attained in accordance with the present invention wherein there is provided a collapsible cable or wire spool stand which, when erected, provides a stable platform about which a spool of cable or wire material can be supported to permit the withdrawal of cable or wire contained on the spool. The support structure may be readily collapsed from its erected configuration to minimize storage space. In a collapsed configuration, the horizontally disposed axle, upon which the spool is supported functions as a convenient handle to form a convenient handle for carrying the spool support stand. The cable spool support axle is releasably secured to the collapsible stand by means of a pair of latches which are supported from a pair of brackets which include a bearing surface formed therefrom to provide an increased surface area upon which the spool support axle is carried when the spool support stand is in use.

DESCRIPTION OF THE DRAWINGS

Further objects of the invention, together with additional features contributing thereto and advantages accruing therefrom, will be apparent from the following description of a preferred embodiment of the invention, which is shown in the accompanying drawings with like reference numerals indicating corresponding parts throughout, wherein:

FIG. 1 is a perspective view of the cable spool support, or holder, shown in an erected condition with the latch mechanism open and the spool supporting axle positioned out from engagement with and above the support stand to better illustrate the elements of the invention;

FIG. 2 is an enlarged end view of the cable spool support structure shown in FIG. 1, with the latch mechanism shown in a closed position by solid lines and in an open position as illustrated by phantom lines. The support structure is illustrated in an erected condition by solid lines and in a collapsed position by lines drawn in phantom; and FIG. 3 is a partial cross-sectional view of the cable spool holder illustrated in FIG. 2 taken along the lines 3—3, with a portion of a wire containing spool supported thereon.

DESCRIPTION OF A PREFERRED EMBODIMENT

Referring now to FIG. 1, there is shown a collapsible cable or wire spool support holder or stand which includes a horizontally disposed axle member or spool support rod 1 upon which a spool of cable or wire material (not shown in this figure) is supported so that cable or wire material may be withdrawn therefrom. The axle member 1 is formed with two stepped or undercut portions 2 which are formed therein to be engaged by a latch member 5 to limit the axial movement of the axle member 1 as cable or wire material is withdrawn from a spool, and to retain the axle in a proper position. Each end of the axle member 1 is formed with an undercut portion 2 within which the latch member 5 maybe engaged. Because both ends of the spool holder are constructed the same, only one end or side will be described in detail. The other end or side, marked with corresponding numerals, is similarly constructed.

Referring also to FIG. 2, the spool support stand includes a pair of U-shaped support legs 11 and 12 which are connected at their free ends to a bracket 10 in which the horizontally disposed spool supporting axle 1 is carried. A conventional locking brace 8 is carried between the two legs, and is connected at each of its ends 9 to one of the U-shaped support legs 11 and 12. When the brace 8 is positioned in its locked position, as shown in FIG. 1 and by the solid lines in FIG. 2, the spool support stand is secured in a stable erected configuration.

As best shown in FIGS. 1 and 2, one of the U-shaped support legs 11 is pivotally connected to each of the brackets 10 at its free end, while the other U-shaped support leg 12 has its free end fixed to the brackets 10. This enables the pivotally connected leg 11, upon release of the locking brace 8, to be swung inwardly so that the base of the U-shaped leg 11 is positioned adjacent to the base portion of the U-shaped support leg 12 as illustrated in phantom in FIG. 2. When the leg 11 is swung inwardly in this manner, the spool support stand is collapsed, and substantially less storage space is required than when the spool support stand is in an erected configuration. In the collapsed configuration the axle or spool support rod 1 functions as a handle to facilitate carrying the support stand.

When the spool support stand is to be used, the support leg 11 is pivoted away from the support leg 12, and the locking brace 8 is moved from its folded configuration into its locked position as illustrated in FIG. 2. The latch 5 is pivoted outwardly from engagement with the undercut portion 2 of the support rod 1, enabling the support rod 1 to be lifted free from the support stand. The support rod 1 is inserted through the hollow core of a spool of wire or cable (shown in part at 20 in FIG. 3) and the support rod 1 is then placed back onto the support stand in a position to be engaged by the latch member 5.

As best shown in FIGS. 2 and 3, the latch member 5 is pivotally connected at its lowermost end by a pivot connection 6 to permit the latch member 5 to pivot relative to the bracket 10. A spring 7 is secured at one end to the bracket 10, and at its other end to a pin **5*a* carried by the latch member 5. The pivot point 6 for the latch member 5, and the positioning of the spring 7 on the bracket 10, is such that the latch 5 is biased over center into engagement with the undercut portion 2 of the support rod 1 when moved into engagement therewith. To facilitate pivotal movement of the latch member 5, an outwardly extending ear portion 4 is provided. A user may grasp this ear portion 4 of the latch 5** to conveniently move the latch between its open and closed positions.

As shown in phantom in FIG. 2, the latch member 5 may be pivoted into and retained in an open position to facilitate insertion of the support rod 1 into the brackets 10. The movement of latch member 5 is constricted by a guide slot **10*a*, formed in the bracket 10, which limits the pivotal movement of the latch 5 relative to the bracket 10. In this manner, the latch 5 may be moved out from engagement with the undercut portion 2 of the support rod 1 (as shown in phantom in FIG. 2). The positioning of the spring 7, and the configuration of the guide slots 10*a*, holds the latch 5 into an open position until the latch moved, and held, into a closed position engaging the support rod 1**.

When a spool of material is supported on the support rod 1, the spool holder may be carried with the spool of material positioned on the support rod. To this end, the hook-like configuration of the latch 5, in cooperation with the curved guide slot **10*a* formed in each bracket 10, function to permit the spool holder to be carried by the base part of either of the U-shaped support legs 11 or 12. Because of the configuration of the curve of the guide slot 10*a*, in which pin 5*a* of the latch 5 is retained, being over-the-center, when the spool holder is inverted, the weight of the spool against the support rod 1 will be applied against the inner surface 5*b* of the latch 5. The hook-like configuration of the latch 5 will cause the pin 5*a* to bear against the guide slot 10*a* resulting in the weight of the spool itself applying a force to retain the support rod 1 in the brackets 10. In this manner, spooled material can be carried on the spool holder without reliance on the spring 6 to hold the latch 5** in a closed position.

Because the spool of cable or wire material is generally relatively heavy, the bracket 10 includes an enlarged bearing surface **10*b* formed from a portion of the bracket 10 which has been removed to provide a channel 14 in which the support rod 1 is positioned. This bearing surface 10*b* distributes the weight imposed upon the bracket 10 in a manner to evenly distribute the loading imposed through the support rod 1 onto the brackets 10**. In this manner, the loading forces are more evenly distributed, without necessitating the incorporation of an expensive bearing surface.

While the invention has been described in the specification and illustrated in the drawings with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description or scope of the appended claims.

What is claimed is:

1. A cable or wire spool holder collapsible from an erected material dispensing configuration into a compact storage configuration comprising a first fixed support leg means and a second pivotal support leg means operatively connected for supporting a spool of material from which material is to be withdrawn, a pair of bracket means, each one of said bracket means mutually exclusively connected to one end of each of said first and second support leg means, a pair of locking braces, each one of said locking braces mutually exclusively connected at the ends thereof to one of said first or second support leg means for positioning said first and second support leg means in predetermined erected or collapsed configurations, said first support leg means being fixedly connected to each one of said pair of bracket means, said second support leg means being pivotally connected to each one of said pair of bracket means for pivotal movement relative thereto between an erected configuration spaced from said first support leg means by said locking braces or a collapsed configuration positioned adjacent said first support leg means, a spool support rod extending between and supported by said pair of bracket means for supporting a spool thereupon when the spool holder is in an erected material dispensing configuration and for forming a carrying handle for the spool holder when collapsed into a compact storage configuration, said pair of bracket means being formed with a channel in which said spool support rod is carried and a portion of said pair of bracket means which is removed in forming said channel being positioned to be engaged by said spool support rod to form a bearing surface therefor, and latching means carried by each one of said pair of bracket means to selectively retain said spool support rod therein.

2. A cable or wire spool holder collapsible from an erected material dispensing configuration into a compact storage configuration comprising a first fixed support leg means and a second pivotal support leg means operatively connected for supporting a spool of material from which material is to be withdrawn, a pair of bracket means, each one of said bracket means mutually exclusively connected to one end of each of said first and second support leg means, a pair of locking braces, each one of said locking braces mutually exclusively connected at the ends thereof to one of said first or second support leg means for positioning said first and second support leg means in predetermined erected or collapsed configurations, said first support leg means being fixedly connected to each one of said pair of bracket means, said second support leg means being pivotally connected to each one of said pair of bracket means for pivotal movement relative thereto between an erected configuration spaced from said first support leg means by said locking braces or a collapsed configuration positioned adjacent said first support leg means, a spool support rod extending between and supported by said pair of bracket means for supporting a spool thereupon when the spool holder is in an erected material dispensing configuration and for forming a carrying handle for the spool holder when collapsed into a compact storage configuration, latching means carried by each one of said pair of bracket means to selectively retain said spool support rod therein, and a pair of spring means with each one of said spring means mutually exclusively connected at one end to one of said pair of bracket means, and the other end thereof being connected to said latching means for biasing said latching means into predetermined open and closed positions.

3. The cable or wire spool holder defined by claim 1 wherein said spool support rod is formed with a stepped portion adjacent each end for engagement with said latching means to retain said spool support rod in said bracket means.

4. The cable or wire spool holder defined by claim 1 wherein said pair of bracket means is formed with a channel in which said spool support rod is carried.

5. The cable or wire spool holder defined by claim 2 wherein said latching means includes a tab portion engageable to facilitate moving said latching means between said open and closed positions.

6. A cable or wire spool holder collapsible from an erected material dispensing configuration into a compact storage configuration comprising a first fixed support leg means and a second pivotal support leg means operatively connected for supporting a spool of material from which material is to be withdrawn, a pair of bracket means, each one of said bracket means mutually exclusively connected to one end of each of said first and second support leg means, a pair of locking braces, each one of said locking braces mutually exclusively connected at the ends thereof to one of said first or second support leg means for positioning said first and second support leg means in predetermined erected or collapsed configurations, said first support leg means being fixedly connected to each one of said pair of bracket means, said second support leg means being pivotally connected to each one of said pair of bracket means for pivotal movement relative thereto between an erected configuration spaced from said first support leg means by said locking braces or a collapsed configuration positioned adjacent said first support leg means, and a spool support rod extending between and supported by said pair of bracket means for supporting a spool thereupon when the spool holder is in an erected material dispensing configuration and for forming a carrying handle for the spool holder when collapsed into a compact storage configuration, latching means carried by each one of said pair of bracket means to selectively retain said spool support rod therein, said latching means comprising a pivotal hook-shaped latch having a guide pin and said bracket means including a guide slot within which said guide pin is movable to define the limits of pivotal movement of said hook-shaped latch, said guide slot being curved and extending a sufficient length to form an abutment for preventing pivotal movement of said hook-shaped latch when a force is applied to the inner surface of the hook shape.

* * * * *